US010889933B2

(12) United States Patent
Choi et al.

(10) Patent No.: US 10,889,933 B2
(45) Date of Patent: Jan. 12, 2021

(54) CLOTHES DRYER AND METHOD OF MANUFACTURING CLOTHES DRYER

(71) Applicant: SAMSUNG ELECTRONICS CO., LTD., Suwon-si (KR)

(72) Inventors: Gyu Min Choi, Suwon-si (KR); Sam Young Jang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 41 days.

(21) Appl. No.: 16/283,075

(22) Filed: Feb. 22, 2019

(65) Prior Publication Data

US 2019/0264377 A1 Aug. 29, 2019

(30) Foreign Application Priority Data

Feb. 23, 2018 (KR) ..... 10-2018-0022220

(51) Int. Cl.
*D06F 58/06* (2006.01)
*D06F 58/30* (2020.01)
*D06F 37/00* (2020.01)

(52) U.S. Cl.
CPC ..... *D06F 58/06* (2013.01); *D06F 58/30* (2020.02); *D06F 37/00* (2013.01); *D06F 2210/00* (2013.01); *D06F 2222/00* (2013.01)

(58) Field of Classification Search
CPC ..... D06F 58/06; D06F 58/30; D06F 37/00; D06F 2210/00; D06F 2222/00
USPC ..... 34/601
See application file for complete search history.

(56) References Cited

U.S. PATENT DOCUMENTS 2,547,238 A * 4/1951 Tremblay ..... F26B 9/066 34/603
3,301,024 A * 1/1967 Smith ..... D06F 58/30 68/12.15
3,513,566 A * 5/1970 Baird ..... D06F 58/02 34/601

(Continued)

FOREIGN PATENT DOCUMENTS

DE 102006023951 A1 * 11/2006 ..... D06F 58/06
DE 102006023951 B4 * 2/2012 ..... D06F 58/06

(Continued)

OTHER PUBLICATIONS

Extended European Search Report and related documents dated Jun. 6, 2019 in European Patent Application No. 19158859.9.

*Primary Examiner* — Stephen M Gravini
(74) *Attorney, Agent, or Firm* — Staas & Halsey LLP

(57) ABSTRACT

Disclosed is a clothes dryer including a bearing capable of stably supporting an up and down movement of a drum caused by an unbalanced load inside a drum upon the rotation of the drum, and a method for manufacturing the same. The clothes dryer includes a cabinet provided with a rear plate, a drum rotatably installed inside the cabinet, a shaft configured to transmit a rotational force to the drum, a bearing unit configured to support the shaft and placed between the rear plate and the shaft, and a bearing hole placed on the rear plate and to which the bearing unit is coupled, and the bearing unit includes a ball bearing provided with an inner ring and an outer ring, a bearing housing configured to support the outer ring and inserted into the bearing hole and a bearing bracket coupled to the bearing housing.

17 Claims, 10 Drawing Sheets

(56) References Cited

U.S. PATENT DOCUMENTS 4,407,078 A * 10/1983 Takeyama ..... D06F 58/08 34/139
4,756,640 A * 7/1988 Gehrke ..... F16B 21/16 403/326
5,105,636 A 4/1992 Anastase et al.
5,133,617 A * 7/1992 Sokn ..... F04D 29/626 403/343
5,203,093 A * 4/1993 Baker ..... H02K 7/14 34/601
5,463,883 A 11/1995 Pellerin et al.
5,548,908 A * 8/1996 Torborg ..... D06F 58/06 34/601
7,093,378 B2 * 8/2006 Jeong ..... D06F 58/08 310/51
7,523,564 B2 * 4/2009 Doh ..... D06F 58/06 34/601
7,661,202 B2 * 2/2010 Han ..... D06F 58/08 34/595
8,627,580 B2 * 1/2014 Kim ..... D06F 37/02 34/601
8,997,533 B2 * 4/2015 Kim ..... D06F 37/00 68/140
9,746,238 B2 * 8/2017 Lim ..... D06F 25/00
10,487,432 B2 * 11/2019 Mikkelsen ..... D06F 37/225
2006/0260150 A1 11/2006 Doh
2017/0152622 A1 * 6/2017 Mikkelsen ..... D06F 37/225
2019/0264377 A1 * 8/2019 Choi ..... D06F 58/30

FOREIGN PATENT DOCUMENTS

EP 3530800 A1 * 8/2019 ..... D06F 58/30
KR 10-2005-0038494 7/2005
KR 10-0710375 4/2007
KR 10-1639022 7/2016

* cited by examiner

CLOTHES DRYER AND METHOD OF MANUFACTURING CLOTHES DRYER

CROSS-REFERENCE TO RELATED APPLICATION(S)

This application is based on and claims priority under 35 U.S.C. § 119 to Korean Patent Application No. 10-2018-0022220, filed on Feb. 23, 2018, in the Korean Intellectual Property Office, the disclosure of which is incorporated by reference herein in its entirety.

BACKGROUND

1. Field

The disclosure relates to a clothes dryer, and more particularly, to a clothes dryer including a bearing configured to stably support an up and down movement of a drum and a method of manufacturing the clothes dryer.

2. Description of Related Art

A clothes dryer is a home appliance for drying wet clothes, and allows the clothes inside the drum to be dried by allowing hot air to pass through the drum while rotating the drum containing the clothes at a low speed.

The clothes dryer may include a drum rotatably installed, a driver configured to drive the drum, a blower configured to blow air into the rotating drum, and a heater configured to heat the air.

When the clothes dryer is operated after the laundry is put into the drum, the drum is rotated by the operation of the driver, and hot air is supplied into the drum by the operation of the heater and the blower.

When the drum is rotated, objects to be dried in the drum falls from the upper side to the lower side or rises from the lower side to the upper side. The drum may also be moved up and down, as the object to be dried in the drum is deflected toward the upper side or the lower side of the drum. Accordingly, a bearing capable of supporting a rotating axis of the drum that is moved up and down is required.

SUMMARY

Therefore, it is an aspect of the present disclosure to provide a clothes dryer including a bearing capable of stably supporting an up and down movement of a drum caused by an unbalanced load inside a drum upon the rotation of the drum, and a method for manufacturing the same.

It is another aspect of the present disclosure to provide a clothes dryer including a bearing capable of having an improved productivity and durability and a method for manufacturing the same.

Additional aspects of the present disclosure will be set forth in part in the description which follows and, in part, will be obvious from the description, or may be learned by practice of the present disclosure.

In accordance with an aspect of the disclosure, a clothes dryer includes a cabinet provided with a rear plate, a drum rotatably installed inside the cabinet, a shaft configured to transmit a rotational force to the drum, a bearing unit configured to support the shaft and placed between the rear plate and the shaft, and a bearing hole placed on the rear plate and to which the bearing unit is coupled, and the bearing unit includes a ball bearing provided with an inner ring and an outer ring, a bearing housing configured to support the outer ring and inserted into the bearing hole and a bearing bracket coupled to the bearing housing.

The first direction may include a radial direction of the shaft and the second direction may include an axial direction of the shaft.

The rear plate may be placed between the bearing unit and the bearing bracket.

The clothes dryer may further include a coupling hole provided on the rear plate to allow the bearing unit or the bearing bracket to be inserted there into when the bearing unit and the bearing bracket are coupled to each other.

The clothes dryer may further include a bush configured to reduce a distance between the bearing unit or the bearing bracket and the coupling hole when the bearing unit or the bearing bracket is inserted into the coupling hole.

The rear plate may further include a curling portion formed by bending an edge of the bearing hole outwardly of the bearing hole.

A length of the curling portion in the axial direction of the shaft may be less than the second gap.

The bearing unit may include a bearing coupled to the shaft; and a bearing housing configured to accommodate the bearing.

The bearing bracket may include a housing hole configured to allow the bearing housing to be inserted there into, and a coupling protrusion protruding from an edge of the housing hole to the center of the housing hole.

The bearing housing may include a coupling groove configured to allow the coupling protrusion to be inserted in the axial direction of the shaft and the circumferential direction of the shaft.

In accordance with another aspect of the disclosure, a clothes dryer includes a cabinet, a rear plate configured to form a rear surface of the cabinet and provide with a bearing hole, a drum rotatably installed inside the cabinet and provided with a shaft, a bearing unit configured to support a rotation of the shaft by being coupled to the shaft and inserted into the bearing hole from the inside of the rear plate, the bearing unit configured to be movable in the bearing hole, and a bearing bracket coupled to the bearing unit to prevent the bearing unit from being separated from the bearing hole, the bearing bracket coupled to the bearing unit from the outside of the rear plate.

The rear plate may be placed between the bearing unit and the bearing bracket.

The bearing unit may be movable in a predetermined range in an axial direction of the shaft and a radial direction of the shaft when the drum rotates.

The rear plate may further include a coupling hole configured to allow the bearing unit or the bearing bracket to be inserted there into when the bearing unit and the bearing bracket are coupled to each other.

In accordance with another aspect of the disclosure, a method of manufacturing a clothes dryer including a cabinet; a drum rotatably install inside the cabinet and provided with a shaft; and a bearing unit configured to be coupled to the shaft, the method includes inserting the bearing unit to a bearing hole of the cabinet, coupling the shaft to the bearing unit, and coupling the bearing bracket to the bearing unit to prevent the bearing unit from being separated from the bearing hole.

The bearing unit may be inserted into the bearing hole from the inside of the cabinet, and the bearing bracket may be coupled to the bearing unit from the outside of the cabinet.

The bearing unit may be movable in the bearing hole.

The bearing unit may include a guide groove extending to the axial direction of the shaft and a coupling groove extending to the circumferential direction of the shaft.

The bearing bracket may include a coupling protrusion configured to be inserted into the coupling guide groove or the coupling groove.

When coupling the bearing bracket to the bearing unit, the coupling protrusion may be inserted into the coupling groove after inserting the coupling protrusion into the guide groove.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
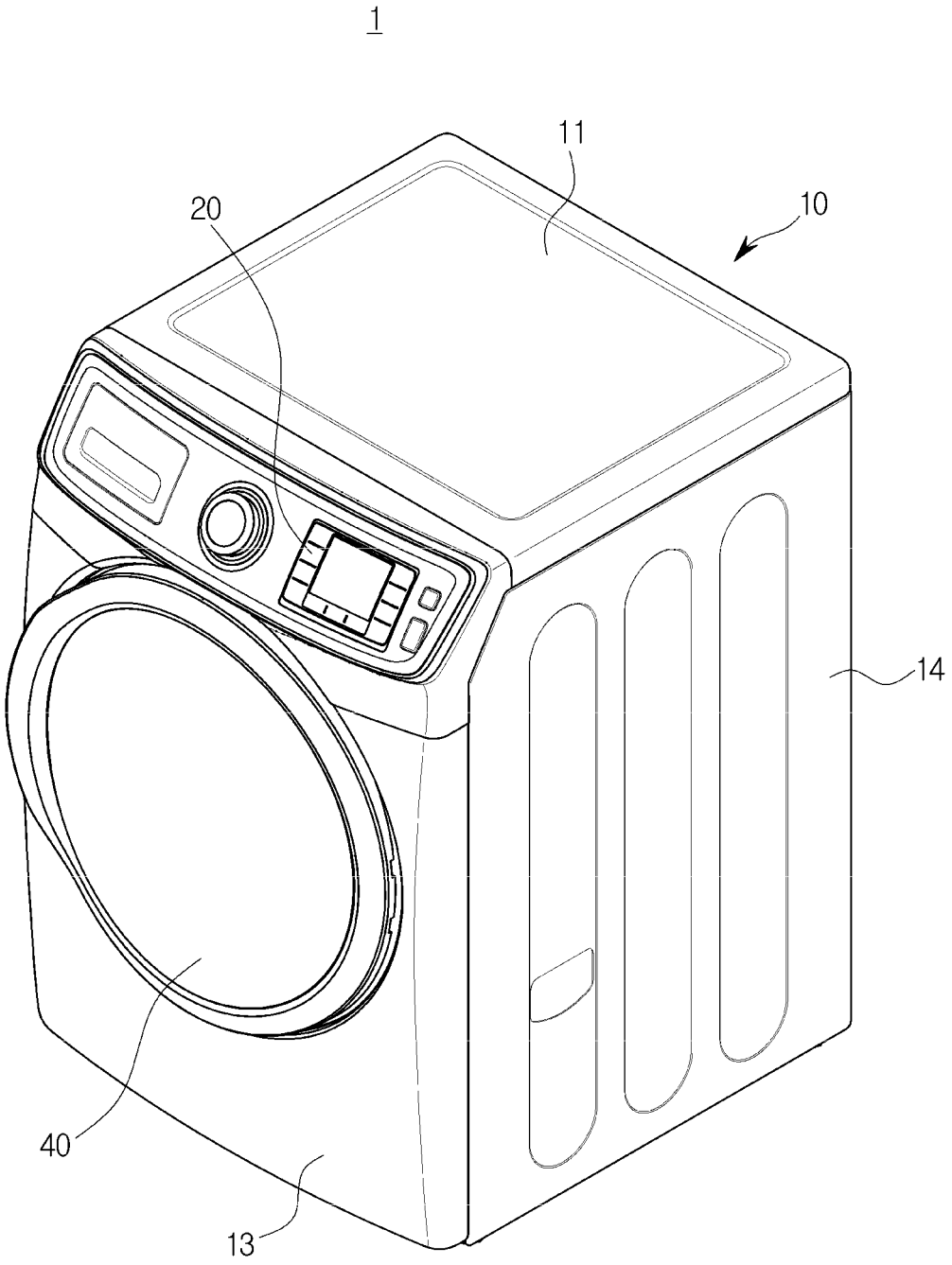
FIG. 1 is a perspective view of a clothes dryer according to an embodiment of the disclosure.

FIGS. 1 through 10, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device. In addition, the same reference numerals or signs shown in the drawings of the present disclosure indicate elements or components performing substantially the same function.

Also, the terms used herein are used to describe the embodiments and are not intended to limit and/or restrict the present disclosure. The singular forms "a," "an" and "the" are intended to include the plural forms as well, unless the context clearly indicates otherwise. In this present disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the present disclosure, a first element may be termed as a second element, and a second element may be termed as a first element. The term of "and/or" includes a plurality of combinations of relevant items or any one item among a plurality of relevant items.

In the following detailed description, the terms of "front end", "rear end", "upper portion", "lower portion", "upper end", "lower end" and the like may be defined by the drawings, but the shape and the location of the component is not limited by the term.

Figure 2:
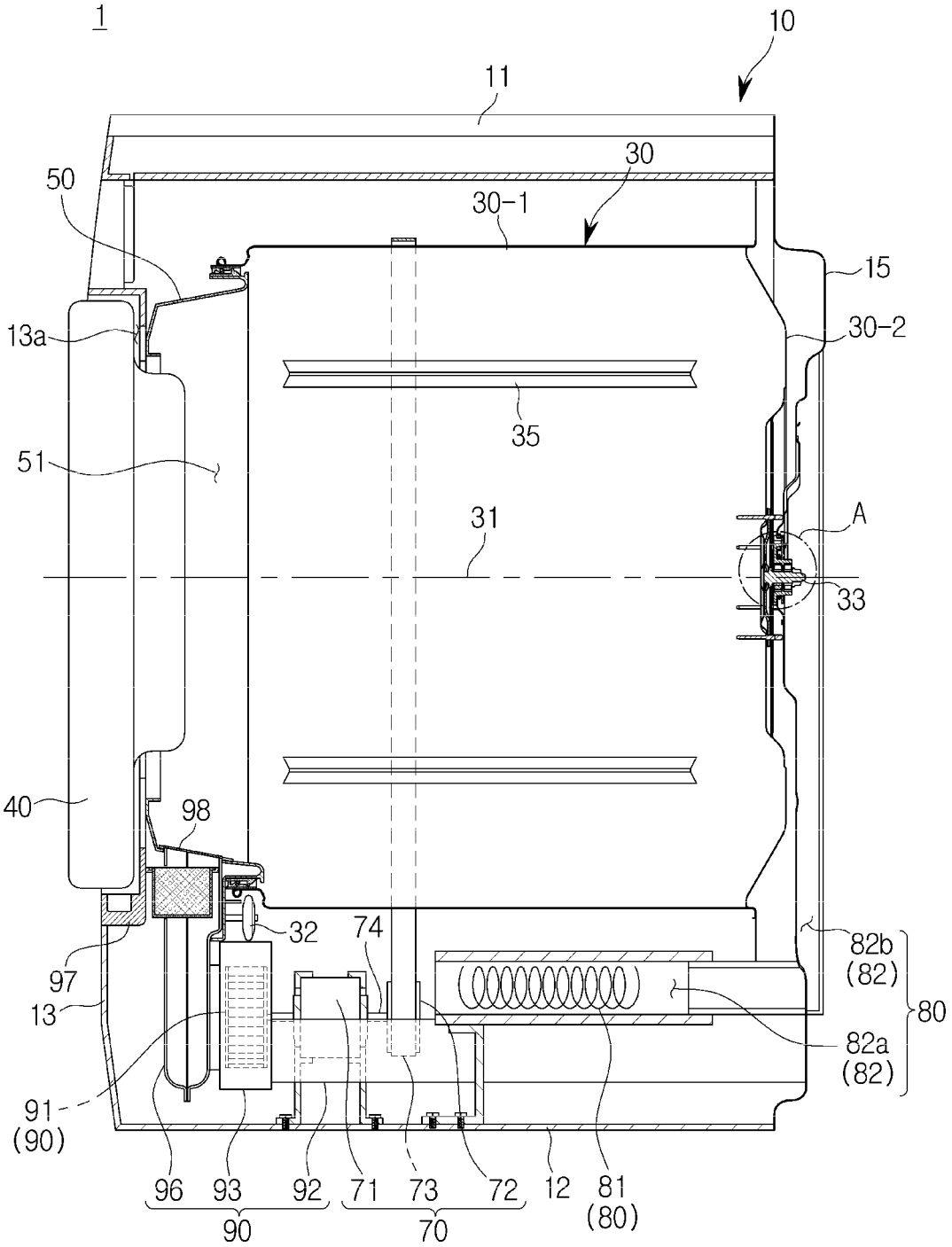
FIG. 2 is a side cross-sectional view of the clothes dryer shown in FIG. 1.

FIG. 1 is a perspective view of a clothes dryer according to an embodiment of the disclosure and FIG. 2 is a side cross-sectional view of the clothes dryer shown in FIG. 1.

As illustrated in FIGS. 1 and 2, a clothes dryer 1 may include a cabinet 10 forming the external appearance.

The cabinet 10 may have a substantially box shape. Particularly, the cabinet 10 may include an upper plate 11, a bottom plate 12, a front plate 13, a left plate (not shown), a right plate 14 and a rear plate 15.

The front plate 13 of the cabinet 10 may be provided with an inlet 13*a* configured to allow an object to be dried to put into a drum 30 or to be taken out from the drum 30. A laundry inlet 51 to be described later may be formed in a front support frame 50 to correspond to the inlet 13*a*. That is, the laundry inlet 51 to be described later may be formed in the front support frame 50 to communicate with the inlet 13*a*.

A control panel 20 may be provided on an upper portion of the front plate 13 to display various information on the clothes dryer 1 or to input an operation command.

The clothes dryer 1 may include the drum 30 provided inside the cabinet 10 to accommodate laundry. The drum 30 may be coupled to the front support frame 50 to come into contact with a sealing member 52.

The drum 30 may have a substantially cylindrical shape with an opening formed in a front surface. The drum 30 may be provided inside the cabinet 10 to be rotatable about a rotating axis 31.

The drum 30 may include a shaft 33. The shaft 33 may be coupled to the rear surface of the drum 30 and configured to rotate together with the drum 30 about the rotating axis 31. The clothes dryer 1 according to an embodiment of the disclosure may be provided such that a side wall 30-1 of the drum 30 and a rear wall 30-2 of the drum 30 rotate integrally. As the side wall 30-1 and the rear wall 30-2 of the drum 30 rotate together about the rotating axis 31, the shaft 33 and a bearing assembly 100 may be provided to support the rotational motion of the rear wall 30-2 from the rear side of the drum 30.

The bearing assembly 100 may include a bearing unit 110 configured to support the rotational motion of the shaft 33 by being coupled to the shaft 33 and a bearing bracket 120 configured to prevent the bearing unit 110 from being separated from the rear plate 15 by being coupled to the bearing unit 110.

The shaft 33 may be fixed to the rear wall 30-2 of the drum to rotate together with the rear wall 30-2 of the drum. At this time, a flange shaft 34 may be provided on the rear wall 30-2 of the drum to fix the shaft 33 to the rear wall 30-2 of the drum.

An intake port 36 may be formed in the rear wall 30-2 of the drum and thus hot and dry air capable of drying the object to be dried may flow into the inside of the drum 30 via the intake port 36.

A lifter 35 may be formed on an inner circumferential surface of the drum 30 to lift the object to be dried upon the rotation of the drum 30. As the drum 30 rotates, the object to be dried may be repeatedly raised and dropped by the lifter 35. At this time, an unbalanced load may occur in the drum 30 due to the rise or fall of the object to be dried. The drum 30 may move within a predetermined range due to the unbalanced load inside the drum 30. That is, the rotating axis 31 of the drum 30 may move within a predetermined range in all directions. The movement in all directions may include a movement in which an inclination of the rotating axis 31 is not changed, and a movement in which an inclination of the rotating axis 31 is changed. The movement in which the inclination of the rotating axis 31 is not changed may include a movement in which the rotating axis 31 moves in the radial direction of the shaft 33 and a movement in which the rotating axis 31 moves in the axial direction of the shaft 33. The above-mentioned predetermined range may represent a distance of about several millimeters (mm) to several tens of millimeters (mm).

When the bearing unit coupled to the shaft is fixed to the rear plate, the bearing unit may not stably support the movement of the shaft in the predetermined range due to the unbalanced load inside the drum. When the bearing unit is fixed so not to be movable in any direction, the unbalanced load inside the drum may be transmitted to the shaft or the bearing unit, and thus the shaft or the bearing unit may be damaged. That is, the durability of the bearing unit or the shaft may be degraded.

According to the conventional manner, a spherical bearing unit has been used to support the movement in the predetermined range of the shaft. The spherical bearing unit may represent a bearing unit having an inner surface of the bearing housing and an outer surface of the bearing having a shape similar with a part of the sphere. As for the spherical bearing unit, the shaft coupled to the bearing may rotationally move within a predetermined angle range due to the shape of the bearing and the bearing housing. However, such a spherical bearing unit only supports the rotational motion of the shaft, and does not stably support the translational movement of the shaft. At this time, the rotational motion of the shaft may represent a movement in which the inclination of the shaft is changed. Further, the translational movement of the shaft may represent a movement in which the inclination of the shaft is not changed. The translational movement may include the movement of the shaft in the up, down, left, and right directions, and in the front-rear direction. The movement of the shaft in the up, down, left, and right directions may represent a movement of the shaft in the radial direction. The movement of the shaft in the front-rear direction may represent the movement of the shaft in the axial direction.

A roller 32 configured to support the drum 30 to smoothly rotate may be provided on the outer circumferential surface of the drum 30. The roller 32 may be placed in the front lower side of the drum 30, or may be provided in plural. The arrangement and the number of the rollers 32 may vary according to design specifications.

The clothes dryer 1 may further include a door 40 configured to open and close the inlet 13*a*. The door 40 may be rotatably installed on the front plate 13 of the cabinet 10.

The sealing member 52 may not only maintain airtightness between the drum 30 and the front support frame 50 but also reduce frictional resistance between the drum 30 and the front support frame 50.

The clothes dryer 1 may further include a drive unit 70 configured to rotate the drum 30.

The drive unit 70 may include a drive motor 71 installed at the inner lower side of the cabinet 10, and a pulley 72 and a belt 73 configured to transmit the power of the drive motor 71 to the drum 30. The pulley 72 is connected to a rotary shaft 74 connected to the drive motor 71. When the rotary shaft 74 is rotated by the drive motor 71, the pulley 72 may be rotated together with the rotary shaft 74. The belt 73 may be installed to be wound around the outer surface of the pulley 72 and the outer surface of the drum 30. When the belt 73 is rotated by the driving force of the drive motor 71, the drum 30 may be rotated together with the belt 73.

The clothes dryer 1 may further include a hot air supply unit 80 configured to supply hot air into the drum 30.

The hot air supply unit 80 may include a heater 81 configured to heat air that is sucked and an intake duct 82 configured to guide the air, which is heated by the heater 81, to flow into the drum 30.

The intake duct 82 may include a lower intake duct 82*a* install under the drum 30 and a rear intake duct 82*b* install at the rear of the drum 30 to connect the intake port 36 to the lower intake duct 82*a*. Although the heater 81 is shown as being located in the lower intake duct 82*a* in FIG. 2, the position of the heater 81 is not limited thereto and may be variously changed. As an example, the heater 81 may be located in the rear intake duct 82*b*.

The clothes dryer 1 may further include a hot air discharge unit 90 configured to discharge the air, which has dried the object to be dried in the drum 30.

The hot and dry air may be supplied to the inside of the drum 30 by the hot air supply unit 80, and the object to be dried in the drum 30 may be dried by the hot and dry air. The air, which has dried the object to be dried, is in a high temperature and high humidity state and the hot and humid air in the drum 30 may be discharged to the outside of the drum 30 through the hot air discharge unit 90.

The hot air discharge unit 90 may include a fan 91 configured to suction the hot and humid air in the drum 30, and an exhaust duct 92 configured to guide the air, which is suctioned by the fan 91, to allow the air to be discharged to the outside. The fan 91 may be placed in a blowing case 93.

The hot and humid air introduced into the exhaust duct 92 may be guided to a heat exchanger (not shown) and thus moisture contained in the hot and humid may be removed.

The air, in which the moisture is removed by passing through the heat exchanger, may be heated by the heater 81 and then re-flow into the inside of the drum 30 through the intake duct 82, thereby drying the object to be dried.

The hot air discharge unit 90 may further include a filter duct 96 installed under the front support frame 50 and the filter duct 96 may be provided such that one side thereof communicates with the inside of the drum 30 and the other side thereof communicates with the blowing case 93. In other words, the hot air discharge unit 90 may further include a filter duct 96 installed under the drum 30, and the filter duct 96 is provided such that one side thereof communicates with the inside of the drum 30 and the other side thereof communicates with the blowing case 93. The filter duct 96 may be provided with a filter 97 configured to filter out various foreign substances contained in the air flowing into the filter duct 96. The filter 97 may be installed in the cabinet 10 to be put into or taken out.

The air, which has dried the object to be dried, may be discharged to the filter duct 96. Air flowing to the filter duct 96 may be filtered and thus the foreign substances may be filtered out by the filter 97. A filter grille 98 in the form of a mesh may be installed at the inlet of the filter duct 96.

Figure 3:
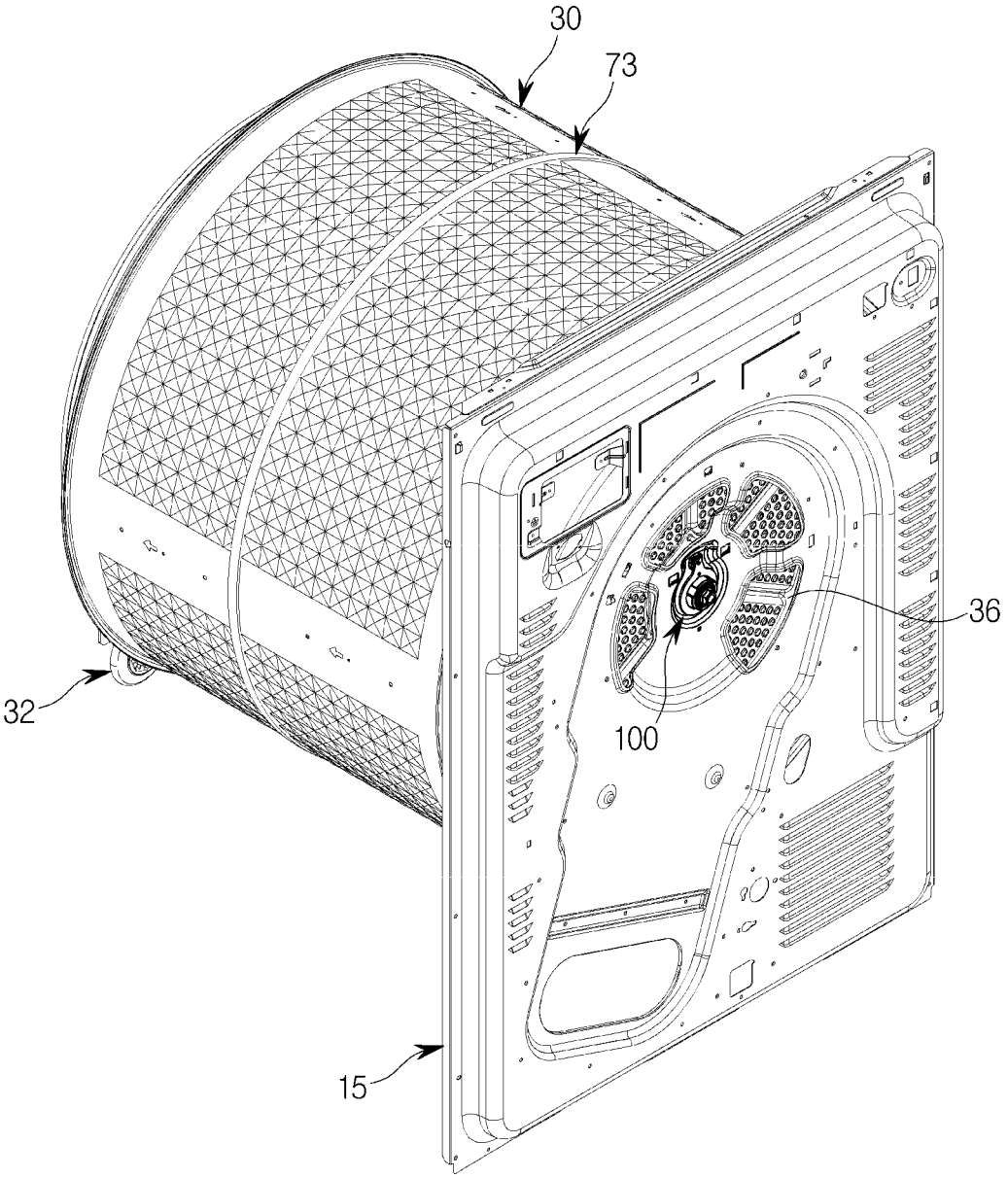
FIG. 3 is a view illustrating a drum, a bearing assembly, and a rear plate in the clothes dryer according to an embodiment of the disclosure.

FIG. 3 is a view illustrating a drum, a bearing assembly, and a rear plate in the clothes dryer according to an embodiment of the disclosure.

As illustrated in FIG. 3, the drum 30 may be coupled to the rear plate 15. Particularly, the shaft 33 may be coupled to the bearing assembly 100, and the bearing assembly 100 may be fitted to the rear plate 15 and thus the drum 30 may be coupled to the rear plate 15.

The rear plate 15 may include a bearing hole 16 configured to allow the bearing unit 110 to be inserted, and a coupling hole 17 configured to couple the bearing unit 110 to the bearing bracket 120. This will be described later.

As shown in the drawings, a plurality of intake ports 36 may be provided, and the number and shape of the intake ports 36 may vary.

Figure 4:
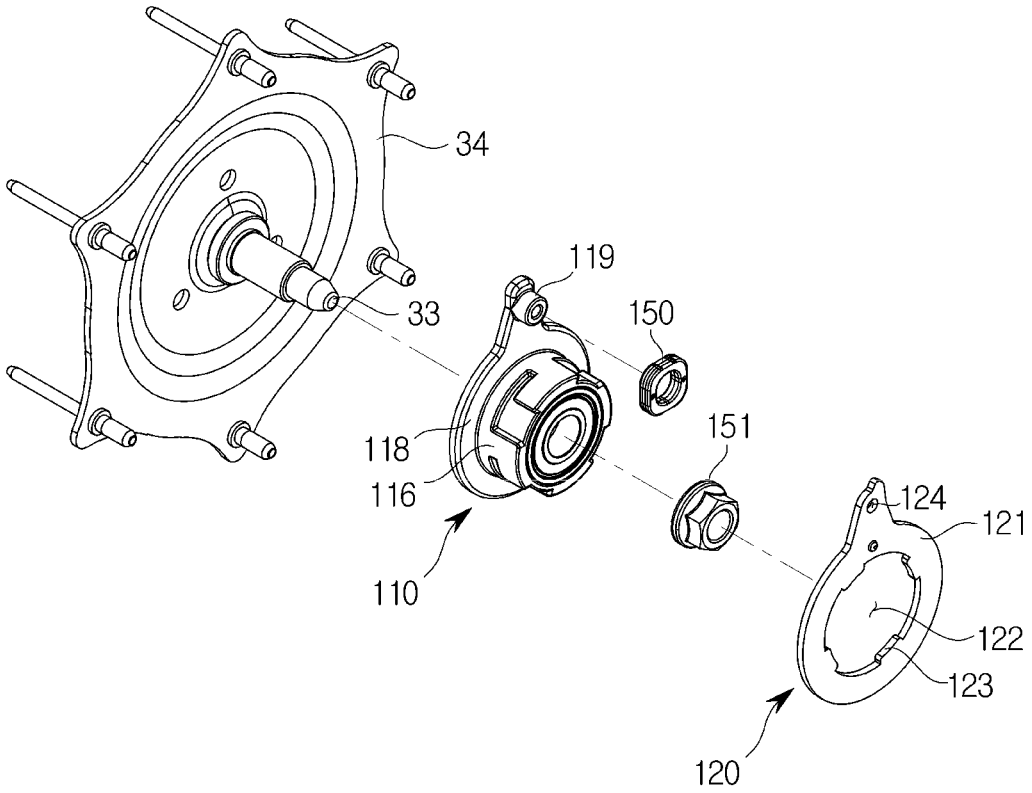
FIG. 4 is an exploded perspective view separately illustrating a shaft and the bearing assembly according to an embodiment of the disclosure.

FIG. 4 is an exploded perspective view separately illustrating a shaft and the bearing assembly according to an embodiment of the disclosure.

As illustrated in FIG. 4, the shaft 33 may be coupled to the flange shaft 34. The flange shaft 34 may be fixed to the rear wall 30-2 of the drum through a plurality of fastening members.

The shaft 33 may be coupled to the bearing unit 110. The bearing unit 110 may support the rotation of the shaft 33. A detailed description of the bearing unit 110 will be described later.

The bearing unit 110 may further include a nut 151 configured to couple the shaft 33 to the bearing unit 110. The nut 151 is screwed to one end of the shaft 33 penetrating the bearing unit 110 to prevent the shaft 33 from being separated from the bearing unit 110 in the axial direction. For this, the shaft 33 may include a threaded portion 33-1 (see FIG. 7). However, there is no particular limitation on the method of coupling the shaft and the bearing unit. In addition to using a nut and a threaded portion, it is possible to couple the shaft to the bearing unit through various known coupling methods.

The bearing bracket 120 may be configured to be coupled to the bearing unit 110. The bearing bracket 120 may be coupled to the bearing unit 110 to prevent the bearing unit 110 from being separated from the bearing bracket 120. The bearing bracket 120 will be described later in detail.

Figure 5:
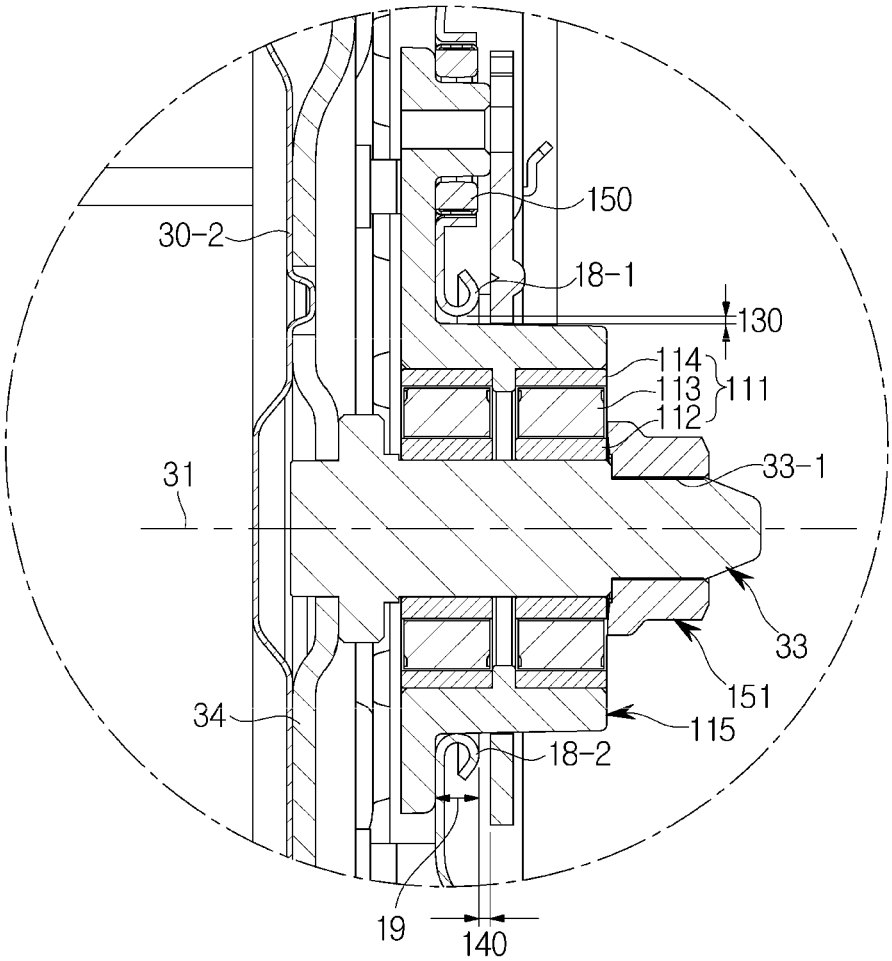
FIG. 5 is an enlarged view illustrating A portion of the clothes dryer according to an embodiment of the disclosure.
Figure 7:
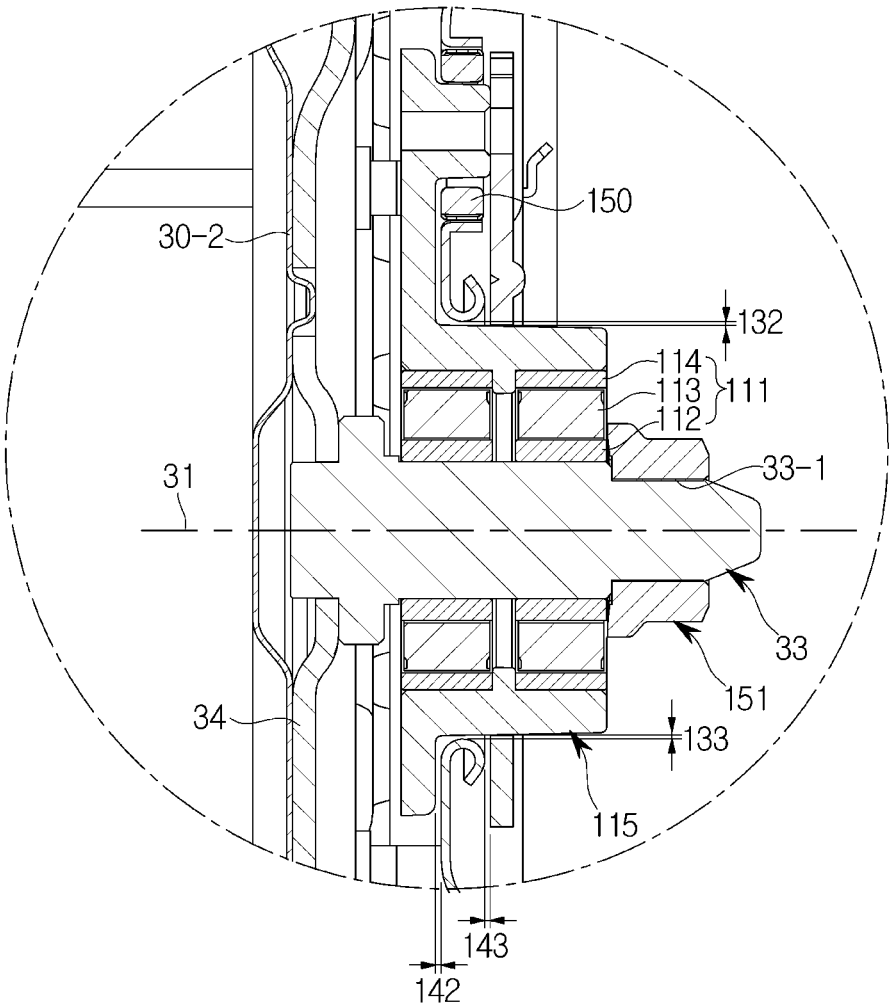
FIG. 7 is an enlarged view illustrating A portion of the clothes dryer according to an embodiment of the disclosure.

FIGS. 5 and 7 are enlarged views illustrating A portion of the clothes dryer according to an embodiment of the disclosure.

The bearing assembly 100 may include the bearing unit 110 and the bearing bracket 120. The rear plate 15 may include the bearing hole 16 and the coupling hole 17.

The bearing unit 110 may include a bearing 111 configured to support the rotation of the shaft 33 and a bearing housing 115 configured to accommodate the bearing 111.

The bearing 111 may include a ball bearing. Hereinafter a ball bearing will be described as an example, but the disclosure is not limited thereto. In addition to ball bearings, various types of bearings may be used.

The bearing 111 may support the rotation of the shaft 33 by being coupled to the shaft 33. The bearing 111 may include an inner ring 112, an outer ring 114, and a ball 113. The inner ring 112 may not rotate relative to the shaft 33. For this, the inner ring 112 and the shaft 33 may be coupled to each other by an interference fit, but is not limited thereto. As described above, the drum 30 may be supplied with the power of the driving motor 71 through the belt 73. At this time, because the drum 30 is not supplied with the power by the shaft 33, the power may be transmitted to the drum 30 even though the inner ring 112 and the shaft 33 rotate relative to each other. The inner ring 112 and the shaft 33 may be coupled to each other by a clearance fit because the power may be transmitted to the drum 30 regardless of whether the inner ring 112 and the shaft 33 rotate relative to each other.

The bearing housing 115 may support the outer ring 114. The bearing housing 115 may be inserted into the bearing hole 16. At this time, a predetermined gap may be provided between the bearing housing 115 and the bearing hole 16.

A plurality of balls 113 may be provided between the inner ring 112 and the outer ring 114. The plurality of balls 113 may be apart from each other along the circumferential direction of the shaft 33. The plurality of balls 113 may assist the relative rotation of the outer ring 112 and the inner ring 114. A lubricant may be applied among the plurality of balls 113, the inner ring 112 and the outer ring 114. The lubricant may reduce the frictional force among the balls 113, the inner ring 112 and the outer ring 114 to smoothly rotate the balls 113 and the inner ring 112 inside the outer ring 114.

The bearing housing 115 may accommodate the bearing 111. The bearing housing 115 may include a cylindrical body 116 having a hollow portion, a flange 118 (see FIG. 8) provided at one end of the body 116, and a first coupling portion 119 (see FIG. 8) extending radially outwardly of the body 116 (see FIG. 8) from the one side of the flange 118.

The bearing 111 may be placed inside the body 116. An outer diameter of the body 116 may be smaller than the bearing hole 16. Accordingly, the body 116 may be fitted in the bearing hole 16, and further move in the bearing hole 16.

The bearing unit 110 may be coupled to the rear plate 15 from one side of the rear plate 15. In other words, the bearing unit 110 may be fitted into the bearing hole 16 and the coupling hole 17 from the inside of the rear plate 15. The body 116 of the bearing housing may be fitted in the bearing hole 16. The first coupling portion 119 of the bearing housing may be fitted in the coupling hole 17.

However, because the bearing unit 110 is not axially fixed to the rear plate 15, the bearing unit 110 may be separated from the rear plate 15. To prevent this, the bearing bracket 120 may be provided. The bearing bracket 120 may be coupled to the bearing unit 110 from the outside or the other side of the rear plate 15. When the bearing bracket 120 is coupled to the bearing unit 110, the bearing unit 110 may not be separated from the rear plate 15. A method of coupling the bearing unit 110 to the bearing bracket 120 will be described later.

The rear plate 15 may further include a curling portion 18 formed by bending the edge of the bearing hole 16 outwardly of the bearing hole 16. The curling portion 18 may reinforce the strength of the edge of the bearing hole 16. For convenience of description, the curling portion 18 may include an upper curling portion 18-1 and a lower curling portion 18-2 in FIGS. 5 to 7. This is for the convenience of description, the curling portion 18 may be formed continuously along the circumference of the bearing hole 16.

Figure 6:
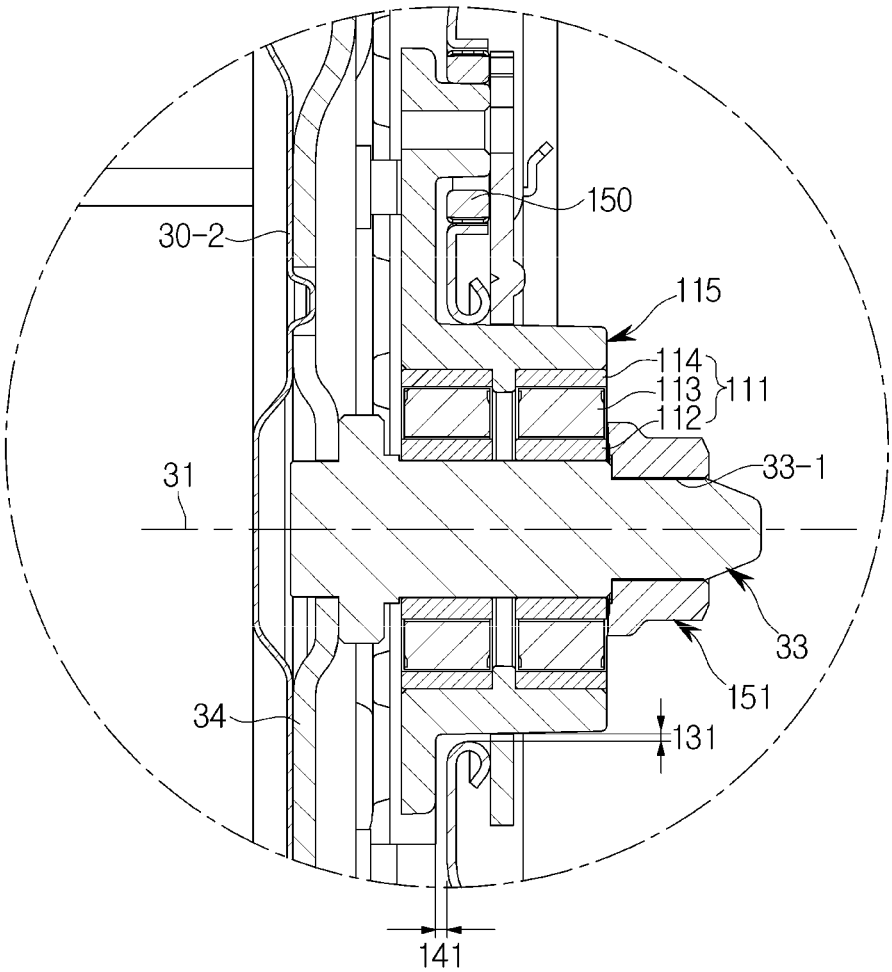
FIG. 6 is an enlarged view illustrating A portion of the clothes dryer according to an embodiment of the disclosure.

Referring to FIGS. 5 to 7, the bearing assembly 100 may move within a predetermined range. For this, a first gap 130 may be provided between the body 116 of the bearing housing and the bearing hole 16 in a first direction. A second gap 140 may be provided between the flange 118 of the bearing housing and the rear plate 15 in a second direction. The first direction may include a radial direction or an up-and-down direction of the shaft 33. The second direction may include an axial direction of the shaft 33, which is a direction intersecting the first direction. The axial direction may indicate the front-rear direction of the clothes dryer 1.

Referring to FIG. 5, the first gap 130 may include a distance between an upper end of the body 116 and a lower end of the upper curling portion 18-1. When the drum 30 does not rotate, the body 116 moves downward due to the weight of the drum 30, and the body 116 comes into contact with the upper end of the lower curling portion 18-2. The first gap 130 may be selected by the outer diameters of the bearing hole 16 and the body 116. When it is required to increase the movement range in the first direction of the bearing assembly 100, it is possible to increase the bearing hole 16, or to reduce the outer diameter of the body 116.

The second gap 140 may include a distance between the bearing bracket 120 and the right end of the curling portion 18. At this time, the right side is defined with respect to the drawing, and may represent the rear of the clothes dryer 1. The second gap 140 may be selected by the distance between the bearing unit 110 and the bearing bracket 120, and a length 19 of the curling portion 18 in the axial direction of the shaft 33. To increase the movement range of the bearing assembly 100 in the second direction, the distance between the bearing unit 110 and the bearing bracket 120 may be increased or the length 19 of the curling portion 18 in the second direction may be reduced.

Referring to FIGS. 6 and 7, as the drum 30 rotates, the bearing assembly 100 may rotate in the first direction and/or the second direction.

As illustrated in FIG. 6, the body 116 may move upward and come into contact with the lower end of the upper curling portion 18-1. At this time, a first gap 131 may be provided between the lower end of the body 116 and the lower curling portion 18-2. As described above, according to an embodiment of the disclosure, the bearing assembly 100 may move upward or downward.

Further, a second gap 141 may be provided between the rear plate 15 and the flange 118 of the bearing housing 115. This is because the bearing assembly 100 moves to the left or to the front of the clothes dryer. As described above, according to an embodiment of the disclosure, the bearing assembly 100 may move in the axial direction of the shaft 33.

As illustrated in FIG. 7, the first gap 132 and 133 may be provided between the body 116 and the upper curling portion 18-1, and between the body 116 and the lower curling portion 18-2, respectively.

In the same manner, the second gap 142 and 143 may be provided between the rear plate 15 and the flange 118, and between the rear plate 15 and the bearing bracket 120, respectively.

As illustrated in FIG. 7, depending on the rotation of the drum, the bearing assembly 100 and the rear plate 15 may not come into contact with each other at any one time.

As illustrated in FIGS. 5 to 7, a bush 150 may be coupled to the first coupling portion 119 of the bearing housing 115. This is to reduce the distance between the first coupling portion 119 and the coupling hole 17 to reduce noise. The bush 150 may be omitted when the size of the coupling hole 17 is reduced.

As mentioned above, according to an embodiment, when the drum 30 rotates, the shaft 33 and the bearing assembly 100 may move within a predetermined range in the up-and-down direction (i.e., the radial direction of the shaft) and/or the front-rear direction (i.e., the axial direction of the shaft). The predetermined range is a value that is pre-selected according to the designer's intention.

The unbalanced load inside the drum 30 allows the shaft 33 and the bearing assembly 100 to move. Unlike the conventional manner, the shaft 33 and the bearing assembly 100 according to an embodiment are not fixed to the rear plate 15 but may be movable within a predetermined range. Accordingly, the impact applied to the shaft 33 and the bearing 111 may be significantly reduced. When the impact applied to the shaft 33 and the bearing 111 is reduced, the risk of damage to the bearing 111 and the shaft 33 may be reduced, which may lead to improvement in durability.

Figure 8:
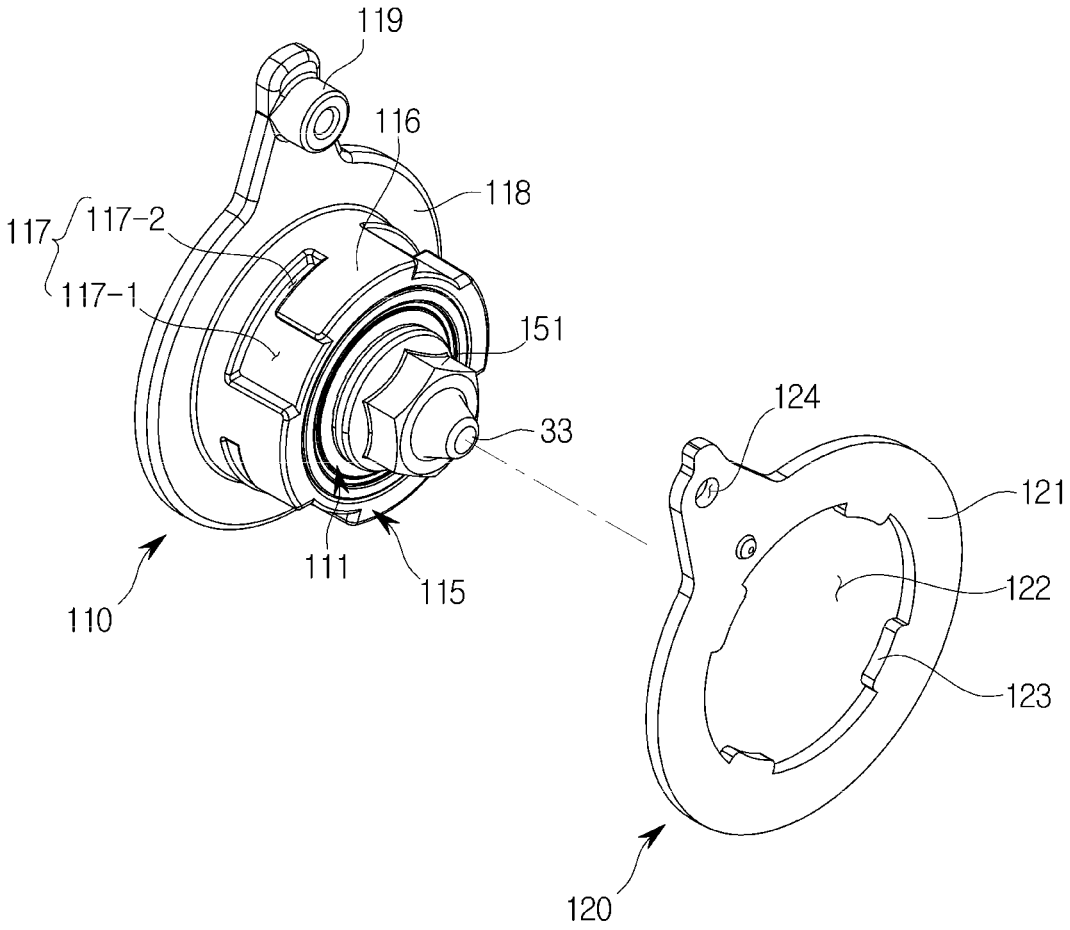
FIG. 8 is a perspective view illustrating a process of coupling a bearing unit and a bearing bracket in the clothes dryer according to an embodiment of the disclosure.
Figure 9:
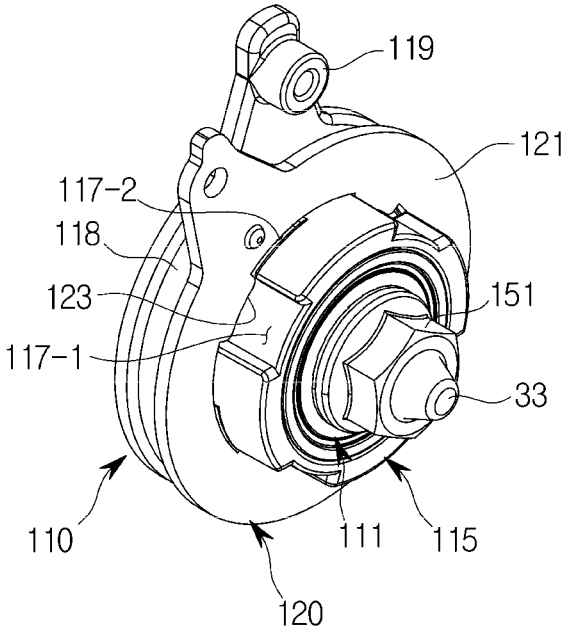
FIG. 9 is a perspective view illustrating a process of coupling a bearing unit and a bearing bracket in the clothes dryer according to an embodiment of the disclosure.
Figure 10:
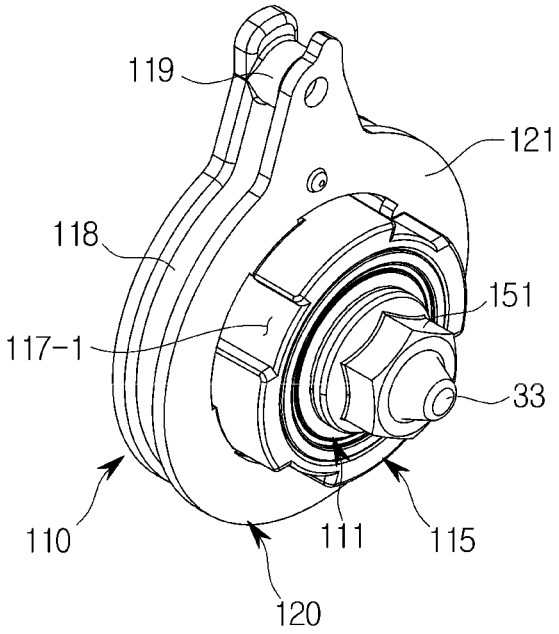
FIG. 10 is a perspective view illustrating a process of coupling a bearing unit and a bearing bracket in the clothes dryer according to an embodiment of the disclosure.

FIGS. 8 to 10 are perspective views illustrating a process of coupling a bearing unit and a bearing bracket in the clothes dryer according to an embodiment of the disclosure.

Referring to FIG. 8, a coupling groove 117 may be formed in the body 116 of the bearing housing 115.

The coupling groove 117 may be provided on the outer circumferential surface of the body 116. The coupling groove 117 may be spaced along the circumferential direction of the body 116. The coupling grooves 117 may be provided in a plural, such as four. However, the number of the coupling grooves 117 may vary.

The coupling groove 117 may include a guide groove 117-1 configured to guide a coupling protrusion 123 of the bearing bracket 120 to be described later, and a locking groove 117-2 configured to prevent the coupling protrusion 123, which is guided by the guide groove 117-1, from being separated in the axial direction of the shaft 33.

The guide groove 117-1 may extend along the axial direction of the body 116 and the locking groove 117-2 may extend along the circumferential direction of the body 116.

The bearing bracket 120 may include a bracket body 121 in the form of a ring including a hollow 122, the coupling protrusion 123 formed to be spaced along the circumference of the hollow 122, and a second coupling portion 124 extending from one side of the bracket body 121 in the radial direction of the bracket body 121.

The bearing 111 and the body 116 may be inserted into the hollow 122. The bearing 111 and the body 116 may be inserted into the hollow 122 by matching the position of the guide groove 117-1 with the position of the coupling protrusion 123. Otherwise, the bearing 111 and the body 116 may be not inserted into the hollow 122.

The number of the coupling protrusions 123 may correspond to the number of the coupling grooves 117. Like the coupling groove 117, the coupling protrusions 123 may be provided in four, but the number of the coupling protrusions 123 may vary.

As illustrated in FIG. 9, when coupling the bearing bracket 120 to the bearing unit 110, the bracket 120 may be inserted in the axial direction of the shaft after matching the position of the coupling protrusion 123 with the position the guide groove 117-1. At this time, when the bearing bracket 120 receives a force in the axial direction of the shaft, the bearing bracket 120 may be separated from the bearing unit 110.

As illustrated in FIG. 10, as the coupling protrusion 123 moves to the end of the guide groove 117-1, and rotates the bearing bracket 120, the bearing bracket 120 and the bearing unit 110 may be locked into each other. In other words, as the coupling protrusion 123 moves from one end of the locking groove 117-2 to the other end of the locking groove 117-2, the bearing bracket 120 and the bearing unit 110 may be locked into each other. Therefore, although the bearing bracket 120 receives a force in the axial direction of the shaft, the bearing bracket 120 is not separated from the bearing unit 110. However when the bearing bracket 120 receives a force in the circumferential direction of the shaft, the bearing bracket 120 returns to the status of FIG. 9. In the state of FIG. 9, the bearing bracket 120 may be separated from the bearing unit 110 by receiving the force in the axis direction of the shaft. In order to prevent this, the first coupling portion 119 and the second coupling portion 124 may be coupled to each other by using a fastening member (not shown) after matching the position of the first coupling portion 119 with the position of the second coupling portion 124. Accordingly, after the first coupling portion 119 and the second coupling portion 124 are coupled to each other, the bearing bracket 120 may be not separated from the bearing unit 110 although the bearing bracket 120 receives a force in the circumferential direction and/or axial direction of the shaft.

Hereinafter a method of manufacturing a clothes dryer according to an embodiment of the disclosure will be described.

According to a method of manufacturing a clothes dryer according to an embodiment, the bearing unit 110 may be inserted into the bearing hole 16 formed in the rear plate 15, the shaft 33 may be coupled to the bearing unit 110, and the bearing bracket 120 may be coupled to the bearing unit 110 to prevent the bearing unit 110 from being separated from the bearing hole 16.

When the bearing unit 110 is inserted into the bearing hole 16, the bearing unit 110 may be inserted into the bearing hole 16 from the inside of the cabinet 10.

When the bearing unit 110 is inserted into the bearing hole 16, the shaft 33 and the bearing unit 110 may be coupled to each other, but is not limited thereto. Alternatively, the bearing unit 110 may be inserted into the bearing hole 16 after the shaft 33 and the bearing unit 110 are coupled to each other. In order to prevent the shaft 33 from being separated from the bearing unit 110, the nut 151 may be screwed to the shaft 33, but is not limited thereto. Therefore, the shaft 33 and the bearing unit 110 may be coupled to each other in many various methods.

The bearing bracket 120 may be coupled to the bearing unit 110 from the outside of the cabinet 10 when the bearing bracket 120 and the bearing unit 110 are coupled to each other. The rear plate 15 may be placed between the bearing unit 110 and the bearing bracket 120. In other words, at least a part of the bearing unit 110 may be placed inside the rear plate 15, and the bearing bracket 120 may be placed outside the rear plate 15.

The bearing unit 110 may be provided movably in the bearing hole 16. For this, the bearing hole 16 may be larger than the outer diameter of the bearing unit 110. Particularly, the body 116 of the bearing housing 115 may be inserted into the bearing hole 16, and the outer diameter of the body 116 may be smaller than the bearing hole 16. Accordingly, the bearing unit 110 may move in the bearing hole 16 in the radial direction of the body 116. As described above, because the bearing unit 110 is movable, the risk of damage to the shaft 33 and the bearing unit 110 may reduced, and the durability may be improved.

The coupling protrusion 123 of the bearing bracket 120 may be inserted into the coupling groove 117 of the bearing unit 110 when the bearing unit 110 and the bearing bracket 120 are coupled to each other.

Particularly, after the coupling protrusion 123 is inserted into the guide groove 117-1 and moved in the axial direction of the body 116, the coupling protrusion 123 may be rotated and inserted into the locking groove 117-2 and then the bearing unit 110 and the bearing bracket 120 may be coupled to each other. The first coupling portion 119 and the second coupling portion 124 may be coupled to each other through a fastening member (not shown) to prevent the rotation of the bearing bracket 120.

As is apparent from the above description, it is possible to provide a clothes dryer including a bearing capable of stably supporting an up and down movement of a drum caused by an unbalanced load inside a drum upon the rotation of the drum, and a method for manufacturing the same.

In addition, it is possible to provide a clothes dryer including a bearing capable of having an improved productivity and durability and a method for manufacturing the same.

Although the present disclosure has been described with various embodiments, various changes and modifications may be suggested to one skilled in the art. It is intended that the present disclosure encompass such changes and modifications as fall within the scope of the appended claims.

What is claimed is:

1. A clothes dryer comprising:

a cabinet having a rear plate formed with a bearing hole;

a drum rotatably installed inside the cabinet;

a shaft coupled to a rear wall of the drum and configured to rotate to transmit a rotational force to the drum; and a bearing assembly having a ball bearing supporting a rotation of the shaft, and having an inner ring and an outer ring positioned around an exterior of the inner ring, a bearing housing inserted into the bearing hole and configured to house the outer ring, and a bearing bracket coupled to the bearing housing through the bearing hole of the rear plate, so that the bearing housing and the rear plate are not separated during the rotation of the shaft.

2. The clothes dryer of claim 1, further comprising:

a coupling hole formed on the rear plate to allow the bearing housing to be inserted there into while the bearing housing and the bearing bracket are coupled to each other.

3. The clothes dryer of claim 2, further comprising:

a bush configured to reduce a distance between the bearing housing and the coupling hole while the bearing housing is inserted into the coupling hole.

4. The clothes dryer of claim 1, wherein the rear plate further comprises a curling portion formed by bending an edge of the bearing hole.

5. The clothes dryer of claim 3, wherein a length of a curling portion in an axial direction of the shaft is less than a gap between the curling portion and bearing bracket in the axial direction while the bearing bracket is coupled to the bearing housing.

6. The clothes dryer of claim 1, wherein
the ball bearing is coupled to the shaft.

7. The clothes dryer of claim 6, wherein
the bearing bracket comprises a housing hole configured to allow the bearing housing to be inserted there into; and
a coupling protrusion protruding from an edge of the housing hole to a center of the housing hole.

8. The clothes dryer of claim 7, wherein
the bearing housing comprises a coupling groove configured to allow the coupling protrusion to be inserted in a axial direction of the shaft and a circumferential direction of the shaft.

9. A clothes dryer comprising:
a cabinet having a rear plate formed with a bearing hole;
a drum rotatably installed inside the cabinet and having a shaft configured to rotate to transmit a rotation force to the drum;
a bearing configured to support a rotation of the shaft by being coupled to the shaft and inserted into the bearing hole from an inside of the rear plate, the bearing configured to be movable in the bearing hole; and
a bearing bracket coupled to the bearing through the bearing hole of the rear plate, so that the bearing and the rear plate are not separated during the rotation of the shaft.

10. The clothes dryer of claim 9, wherein
the bearing is movable in a predetermined range in an axial direction of the shaft and a radial direction of the shaft when the drum rotates.

11. The clothes dryer of claim 9, wherein
the rear plate further comprises a coupling hole configured to allow the bearing to be inserted there into while the bearing and the bearing bracket are coupled to each other.

12. A method of manufacturing a clothes dryer comprising a cabinet having a rear plate formed with a bearing hole; a drum rotatably installed inside the cabinet, a shaft coupled to a rear wall of the drum to rotate to transmit a rotation force to the drum; and a bearing configured to be coupled to the shaft, the method comprising:
inserting the bearing into the bearing hole of the rear plate;
coupling the shaft to the bearing; and
coupling a bearing bracket to the bearing through the bearing hole of the rear plate, so that the bearing and the rear plate are not separated during the rotation of the shaft.

13. The method of claim 12, wherein
the bearing is inserted into the bearing hole from an inside of the cabinet, and the bearing bracket is coupled to the bearing from an outside of the cabinet.

14. The method of claim 12, wherein the bearing is movable in the bearing hole.

15. The method of claim 12, wherein
the bearing comprises a guide groove extending to an axial direction of the shaft and a coupling groove extending along an circumferential direction of the shaft.

16. The method of claim 15, wherein
the bearing bracket comprises a coupling protrusion configured to be inserted into a coupling guide groove or the coupling groove.

17. The method of claim 16, wherein
while coupling the bearing bracket to the bearing, the coupling protrusion is inserted into the coupling groove after inserting the coupling protrusion into the guide groove.

* * * * *